United States Patent [19]

Skibik

[11] Patent Number: 4,961,535

[45] Date of Patent: Oct. 9, 1990

[54] CHAISE LOUNGE MISTING DEVICE

[76] Inventor: John Skibik, 57 Ballston Ave., Apt. 110, Saratoga Springs, N.Y. 12866

[21] Appl. No.: 159,244

[22] Filed: Feb. 23, 1988

[51] Int. Cl.[5] ..... B05B 17/00

[52] U.S. Cl. ..... 239/289; 239/279; 297/180

[58] Field of Search ..... 239/207, 279, 289, 106, 239/110, 111, 547, 550, 562, 571, 581.2, 588; 297/180, 217

[56] References Cited

U.S. PATENT DOCUMENTS

| | | | |
|---|---|---|---|
| 2,770,812 | 11/1956 | Whiteside | 4/145 |
| 2,833,502 | 5/1958 | Wildeboore | 297/217 X |
| 3,042,318 | 7/1962 | Chow et al. | 239/581.2 X |
| 3,295,886 | 1/1967 | Goldmerstein | 297/180 |
| 3,539,181 | 11/1970 | Larsen | 272/56.5 |
| 3,625,434 | 12/1971 | Kitover | 239/289 |
| 3,688,775 | 9/1972 | Raymann | 128/366 |
| 4,548,357 | 10/1985 | Schmidt | 239/289 |

FOREIGN PATENT DOCUMENTS

| | | | |
|---|---|---|---|
| 372806 | 4/1923 | Fed. Rep. of Germany | 239/588 |

*Primary Examiner*—Andres Kashnikow
*Assistant Examiner*—Christopher G. Trainor
*Attorney, Agent, or Firm*—Schmeiser, Morelle & Watts

[57] ABSTRACT

A cool water misting device removably attachable to a chaise lounge and adaptable for use with a wide variety of water supplies for which a garden hose may function as the conduit. A single piece of tubing having adjustable spray nozzles at spaced intervals along its length is attached to the frame of a chaise lounge by clamps. A control for adjusting the direction, amount and pressure of water flow is provided. Water flow drainage for maintaining a constant supply of cool water is included and is controlled by a hand-held trigger which also functions as the on/off switch for the spray nozzles.

5 Claims, 2 Drawing Sheets

CHAISE LOUNGE MISTING DEVICE

FIELD OF THE INVENTION

The present invention relates generally to sunbathing apparatus. More particularly, this invention is a cool water misting device for cooling the occupant of a lawn chair, chaise lounge or the like.

BACKGROUND OF THE INVENTION

There are several advantages to maintaining cool, moist skin while sunbathing. For one, the ability of the sunbather to endure the sun and heat greatly increases, thereby enabling him or her to absorb more of the sun's ultraviolet rays leading to a better tan. Even for those who are not interested in tanning per se, but who desire to remain outdoors merely to enjoy the sunny weather or a sporting event or the like, they are certainly better able to do so if maintained in a comfortable, cool condition. Another advantage lies in the generally accepted proposition that the maintenance of moist skin accelerates the tanning rate; thus, one who wishes to obtain the cosmetically pleasing effects of tanning, but who does not have an exorbitant amount of time for sunbathing, may be able to acquire a deeper, darker tan than otherwise possible in a limited amount of time.

Sunbathing apparatus incorporating means for cooling the user have been disclosed in the prior art. Typically, these devices comprise a cot or chaise lounge having a specially manufactured hollow, tubular frame attachable to a garden hose. Apertures along the frame cause the stream of water flowing through the frame from the hose to be divided into a number of streamlets for cooling the lounge occupant.

Although effective once operating, the aforementioned prior art devices are not only impractical, but are bulky and thus inconvenient to use in locations other than the yard at home or any other location not in close proximity to the storage place for the apparatus. The impracticality results from a lack of versatility; that is, the entire lounge chair operates as the cooling device, thereby rendering it inoperable if the chair frame or a chair leg breaks.

In consideration of the above-described problems with the prior art, Schmidt disclosed a sprinkling device which is attachable to a variety of lawn chairs in U.S. Pat. No. 4,548,357. Schmidt invented a U-shaped, flexible tube attachable to a lawn chair and having water emitting apertures for directing sprays of water toward the occupant. A control valve is used to turn on and off the water supply to the tube. As the only available control mechanism for regulating the flow of water, Schmidt's valve is inconvenient to use because the occupant may have to twist and to reach through water spray or even to get up to turn the device off. Additionally, there are only two available settings, on or off.

None of the prior art devices disclose a simple yet effective drain for maintaining a constant supply of cool water even while the sunbather is not using the water sprays. Rather, most of these devices incorporate a control valve for turning the sprays on and off so that when the user shuts off the cooling device by closing the valve, the water in the garden hose and attached frame or tubing becomes heated by the sun. Subsequently, upon opening the valve, the supply of water first meeting the user's skin is warm or hot depending on the heating period, thus defeating the purpose of the cooling device.

An improved lawn chair sprinkling or misting device is needed which will not only overcome the limitations of the prior art, but which will incorporate additional features providing further comfort and convenience. The improved misting device should be readily adaptable for use on a wide variety of lawn chairs or chaise lounges or the like. Means for controlling the amount and pressure of water to the user which is easily accessible and convenient to use should be provided. Further, the improved cooling device should be adaptable for use with different types of water supplies. Still further, means for keeping a constant supply of cool water readily available to the user is needed.

SUMMARY OF THE INVENTION

The present invention is a cool water misting device attachable to a chair or chaise lounge for cooling a sunbather. The apparatus comprises a single length of tubing removably attachable to the periphery of the lounge by clamps. At specifically spaced intervals along the tubing, there are adjustable spray nozzles for directing sprays of cool water toward the occupant of the chaise lounge. The spray nozzles are mounted on flexible, gooseneck hoses for easy directional adjustment. Additionally, the present invention provides fingertip adjustment of the spray nozzles in order to vary the amount and pressure of water flow.

A hand-held trigger for turning the water sprays on and off is easily accessible to the sunbather and convenient to use. The trigger is connected to a piece of tubing or hose having an adaptor mounted at one end for attachment of the cooling device to a conventional garden hose. Incorporated within the adaptor is a control valve which, when closed, prevents any water flow from the garden hose to the cooling device.

The present invention further includes a water flow drainage means for maintaining a constant supply of cool water. A spring-loaded valve located at the end of the tubing is biased to an open position. In operation, the valve opens upon release of a hand trigger and the concommitant reduction of pressure within the tube so that a single streamlet continuously flows through the tubing, exiting through the drainage valve; thus, with the hand trigger released the water sprays are inoperable. By allowing a continuous flow of Water through the device eVen when the sprays are turned off, water Will not remain stagnant in the hose and tubing, thereby becoming heated by the sun. Upon engagement of the hand trigger, however, the pressure within the tube increases thus closing the run-off valve with the result that the water sprays become fully operable.

The major advantages of the invention are set forth in part herein and in part will be obvious herefrom, or may be learned by practice with the invention, the same being realized and attained by means of the instrumentalities and combinations pointed out in the appended claims.

The invention consists in the novel parts, constructions, combinations and improvements herein shown and described.

The accompanying drawings referred to herein and constituting a part hereof illustrate preferred embodiments of the invention and together with the description, serve to explain principles of the invention.

DETAILED DESCRIPTION OF THE DRAWINGS

Figure 1A:
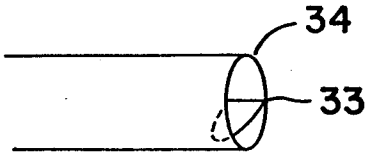
FIG. 1A is a side elevation of the drainage valve of the present invention.
Figure 1:
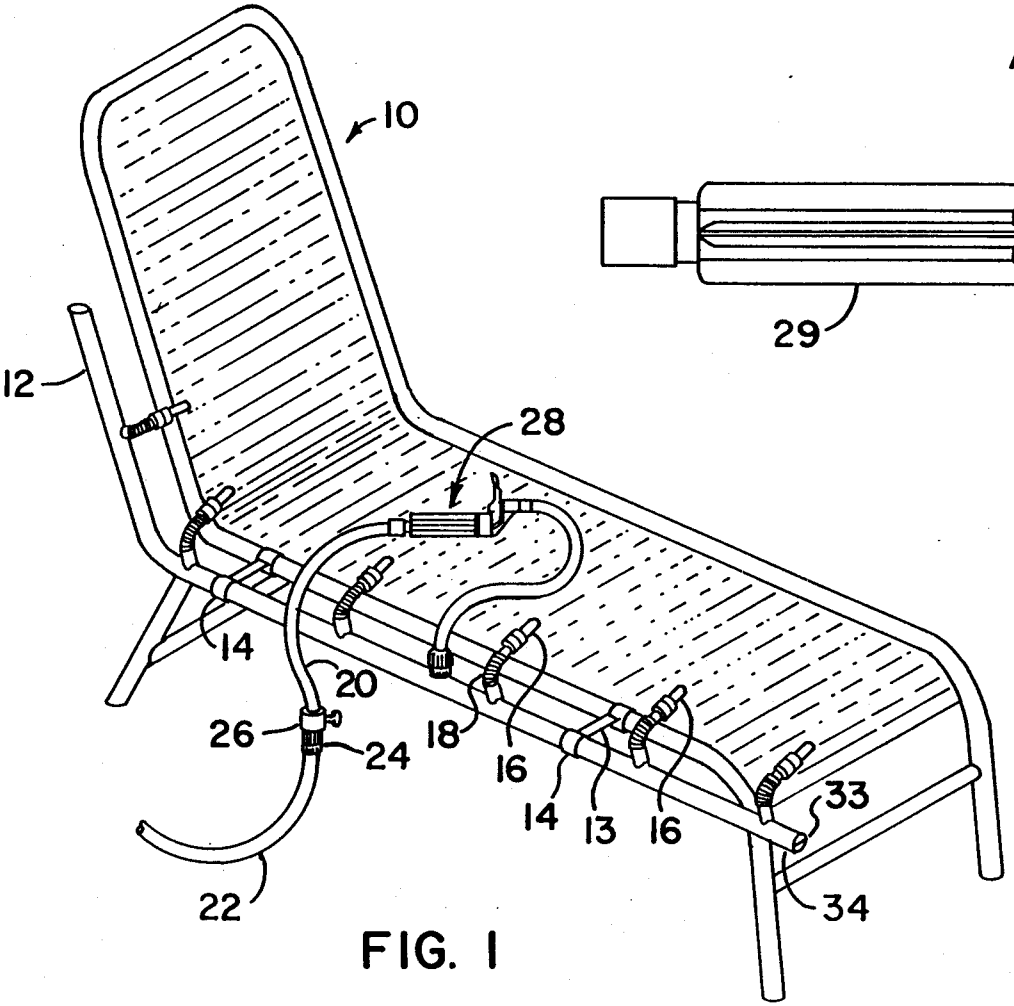
FIG. 1 is a perspective view of a chaise lounge employing the cool water misting device of the present invention.

With reference to FIG. 1, the cool water misting device constructed according to the present invention is shown attached to the frame of a chaise lounge generally designated by the numeral 10. A single length of tubing 12 is removably attached to one side of the chaise lounge 10 by clamps 14. Although the present invention is shown attached to only one side of the chaise lounge in FIG. 1, it may be attached to both sides or around the entire periphery of the lounge. In the preferred embodiment of the present invention, the clamps 14 have extensions 13 for holding the tubing 12 a distance of three to four inches from the lounge frame, thereby enabling a sunbather to lean over the edges of the lounge without interfering with the cooling device. Alternatively, the tubing 12 may be clamped directly adjacent to the lounge frame if desired.

Figure 3:
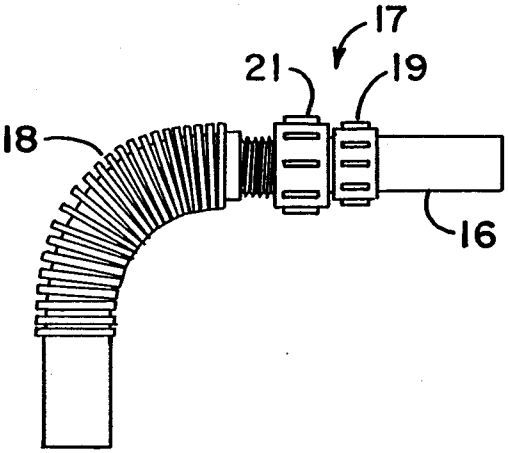
FIG. 3 is a side elevation of an adjustable spray nozzle of the present invention.

A plurality of spray nozzles 16 are located at appropriately spaced intervals along the tubing 12. In the preferred embodiment, each nozzle 16 is attached to the tubing 12 by a piece of flexible, gooseneck hose 18. The resiliency of the gooseneck hose 18 allows for easy directional adjustment of each spray nozzle 16. The amount and pressure of water flow through the spray nozzles 16 may be controlled by valve 17 as shown in FIG. 3. In particular, valve member 19 of spray nozzle 16 may be rotated relative to valve member 21 attached to gooseneck hose 18 in order to regulate the flow of water therethrough. The valve 17 will open more or less, depending on the direction of rotation of spray nozzle 16. In my preferred embodiment the internal valve structure of 17 (not shown) is a round head moveable in relation to an aperture wherein the head may totally block the aperture and rotation of valve member 19 separates the head and aperture allowing water flow. This type of system is well known, and commonly used on hose spray nozzles.

Connected to tubing 12 is another length of tubing 2 for attachment to a water source (not shown) through a conduit 22. A conventional garden hose acts as the conduit 22 in the preferred embodiment of the present invention. An adaptor 24 is mounted to one end of the tubing 20 for receiving one end of the conduit 22. The adaptor 24 includes a manually operated valve 26 for activating and deactivating water flow to the cooling device. Depending on the type of water source, a filter could further be incorporated into the adaptor 24 for inhibiting the passage of dirt particles and the like into the device.

Figure 2:
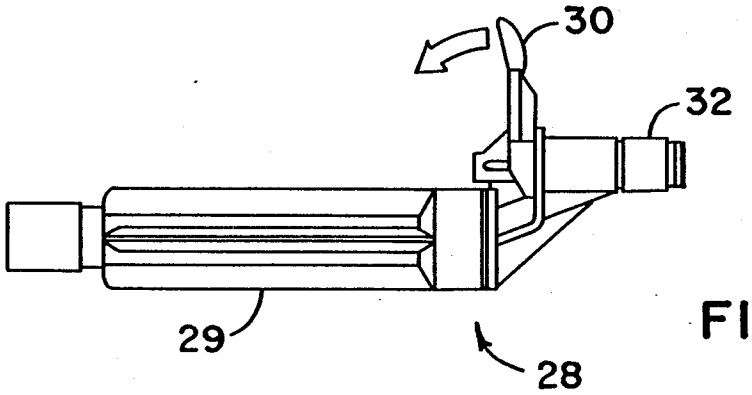
FIG. 2 is a side elevation of the hand trigger used in accordance with the present invention.

As shown in FIGS. 1 and 2, the present invention includes a hand-held trigger 28 having grip 29 which is easily accessible to the occupant of the chaise lounge 10. With the valve 26 open, the sunbather can turn on the water spray nozzles 16 by depressing the trigger arm 30 in the direction shown by the arrow in FIG. 2 in order to open control valve 32. In the preferred embodiment, the trigger arm 30 locks into place so that the sunbather may depress the hand trigger 28 while relaxing and enjoying the cooling sprays of water. When it is desired to turn off the sprays while still relaxing on the chaise lounge, the sunbather merely has to reach for the hand trigger 28 and release the trigger arm 30 so that the control valve 32 closes. Control valve 32 has the same internal configuration as valve 17 so that by rotating control valve 32 a constant flow may be maintained.

Figure 4:
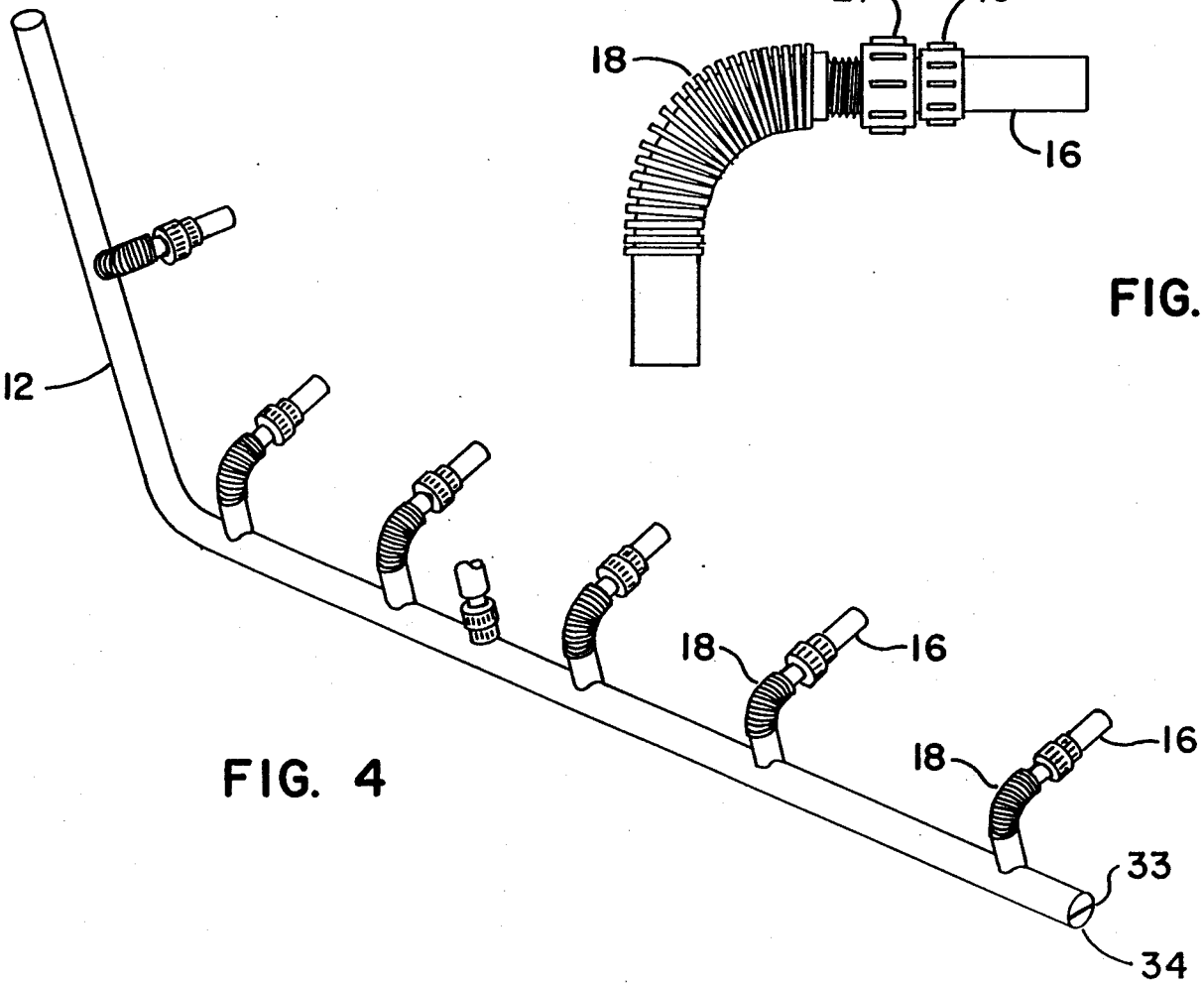
FIG. 4 is a perspective fragmentary view of the cool water misting device of FIG. 1.

Thus, when the trigger arm 30 is released as shown in FIG. 2, the valve 32 does not close completely, but allows for water flow through the tubing 12 and out the drainage valve 34 shown in FIGS. 1A and 4. The drainage valve 34 is controlled indirectly by the hand-held trigger 28. By depressing the trigger arm 30 to its locked open position water pressure builds in the pipe, thereby closing the drainage valve 34. When trigger 30 is released the water pressure is reduced and becomes insufficient to cause water spray from the nozzles 16 or to close drainage valve 34 which is biased by a spring loaded hinge 33 to the open position. However, the water flow is sufficient to maintain a constant supply of cool water. Specifically, the rate of water flow through the tubing may be varied by control valve 32 to a point sufficient to provide a run off of water which would otherwise remain stagnant, and become heated, in the tubing 12 and garden hose 22. In this way, the sunbather who eventually turns on the water spray nozzles 16 can be assured that cool water will be readily and immediately available.

What is claimed is:

1. A cool water misting device for outdoor use on a chaise lounge, comprising:
   - tubing adapted for placement in close proximity to a chaise lounge;
   - an adapter connected to said tubing for receiving a hose, said adaptor having primary valve means for permitting water flow from a water source through the hose to said tubing;
   - a plurality of spray nozzle attached at specifically spaced intervals along said tubing;
   - means for adjusting the direction of water flow from said spray nozzles;
   - means for controlling the amount and pressure of water flow through said spray nozzles, said water flow control means movable between a depressed position increasing water pressure and water flow into the tubing and a release position decreasing the water pressure and flow into the tubing; and
   - water flow drainage means for maintaining a constant supply of cool water, said drainage means including means for closing said drainage means when the water flow control means is moved toward the depressed position and opening said drainage means when the control means is moved to the release position.

2. The invention of claim 1 wherein said water flow control means comprises a hand held trigger mechanism, said trigger mechanism having a secondary water control valve for adjusting the amount of water entering the tube when the trigger is in the release position.

3. The invention of claim 2 wherein said water flow drainage means comprises a drainage valve biased to an open position for allowing a continuous flow of water through said tubing when said trigger is released.

4. The invention of claim 3 wherein said means for adjusting the direction of water flow from said spray nozzles comprises a flexible hose for attaching said spray nozzles to said tubing.

5. The invention of claim 4 wherein said tubing is removably attachable to the chaise lounge by clamps which firmly hold said tubing adjacent to the frame of the chaise lounge.

* * * * *